United States Patent [19]

Daguise

[11] 4,136,612

[45] Jan. 30, 1979

[54] APPARATUS FOR STAMPING ARTICLES, ESPECIALLY METAL SHEETS

[75] Inventor: Dominique D. Daguise, Chevillon, France

[73] Assignee: Societe Anonyme dite: Au Cachet Lorrain, Metz, France

[21] Appl. No.: 738,008

[22] Filed: Nov. 2, 1976

[30] Foreign Application Priority Data

Nov. 3, 1975 [FR] France ..... 75 33572

[51] Int. Cl.[2] ..... B41J 7/78

[52] U.S. Cl. ..... 101/18; 101/93.10; 101/110

[58] Field of Search ..... 101/18, 29, 35, 40–45, 101/99, 110, 368, 93.10, 93.28—93.36

[56] References Cited

U.S. PATENT DOCUMENTS

| | | | |
|---|---|---|---|
| 2,364,345 | 12/1944 | Cooper | 101/44 |
| 3,141,403 | 7/1964 | Brown et al. | 101/99 |
| 3,149,562 | 9/1964 | Wilkins et al. | 101/93.10 |
| 3,169,474 | 2/1965 | Howard | 101/110 |
| 3,226,530 | 12/1965 | Greenblott et al. | 101/93.10 X |
| 3,306,186 | 2/1967 | Voos et al. | 101/29 X |
| 3,397,403 | 8/1968 | Greene | 101/93.10 X |
| 3,991,672 | 11/1976 | Keith et al. | 101/99 |
| 4,020,757 | 5/1977 | Christensen | 101/18 |

*Primary Examiner*—Edward M. Coven
*Attorney, Agent, or Firm*—Bacon & Thomas

[57] ABSTRACT

Apparatus for stamping articles, especially metal sheets. This apparatus includes at least one stamping unit having independent stamping modules. Each module has a character-support. A preselecting device brings a character from each module into the stamping position, while actuating means associated with the modules bring into the working position the preselected characters, which are printed individually.

This device is especially suited for stamping by inking and/or by deformation of metal sheets leaving a rolling facility.

21 Claims, 10 Drawing Figures

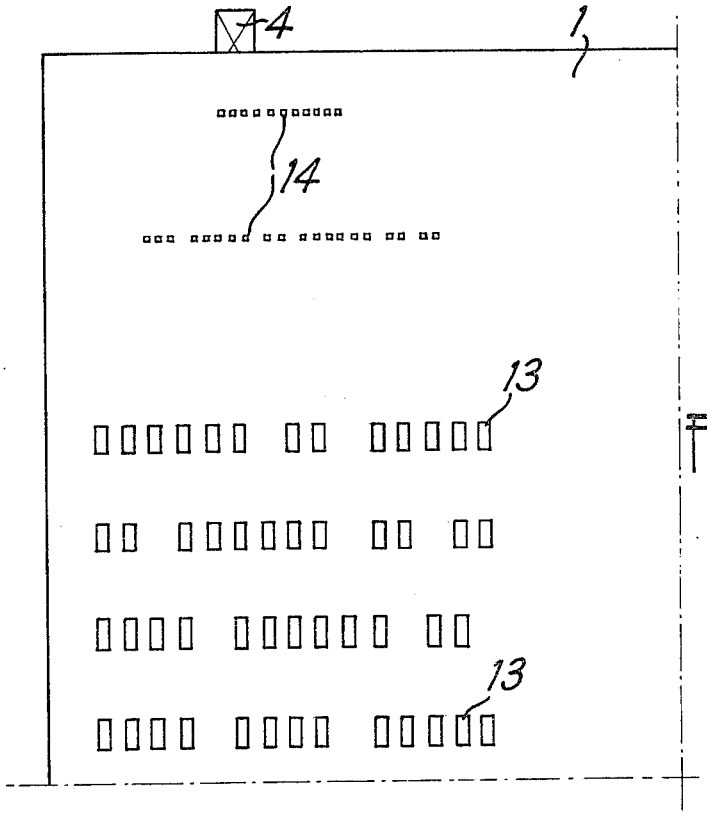
Fig. 3
Fig. 6
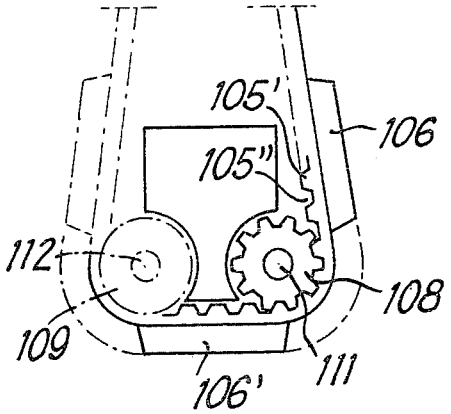
Fig. 7
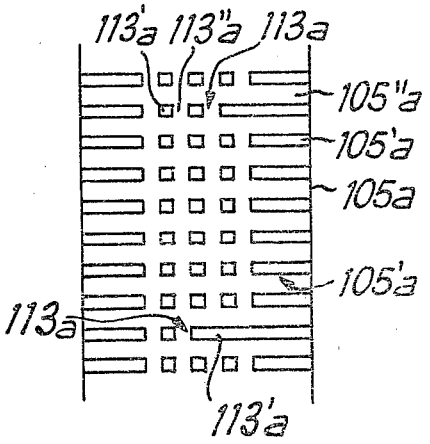

APPARATUS FOR STAMPING ARTICLES, ESPECIALLY METAL SHEETS

The object of the present invention is an apparatus for stamping articles, especially metal sheets, by printing characters on the surface of these articles, and is an apparatus of the type which includes a stamping unit having: several self-moving supports each bearing several characters, a preselecting device for placing in the stamping position an assemblage of predetermined characters, each borne by a different support, and actuating means for bringing said characters, placed in the stamping position, into the working position, contacting the surface of the article to be stamped so that said predetermined characters are printed thereon.

The present invention applies particularly, but not exclusively to the stamping of metal sheets, especially those leaving a rolling facility.

The stamping of sheets following rolling, by inking and/or deformation of their surface, is often carried out manually by persons moving on the sheet itself, which rests on rails. This manual stamping, aside from its arduousness for the operator, is the source of numerous errors and requires a relatively large amount of time.

To eliminate these drawbacks, various devices have been proposed for automatic stamping. One of these known devices has several wheels with characters on their periphery and mounted on a single axis. With each of the wheels placed in a predetermined angular position in order to bring a preselected character into stamping position, the wheels are bolted into their predetermined position and brought simultaneously into working position onto the surface of the article to be stamped. A major drawback of this apparatus resides in the fact that the characters in stamping position are situated on the same level, while the surface of the article to be stamped is not always perfectly flat, which is especially true for rough rolled sheet metal. This results in an uneven printing of the characters, several of the characters printed often being illegible. Another disadvantage appears when the printing is carried out by deformation, since an effective means of support must then be provided for the article to be stamped so that it may receive the total force of stamping or pressure required for simultaneous printing of a group of characters.

With another known apparatus, the printing of the characters is effected by projecting a stamping product onto a perforated band driven by a relative movement in relation to the article to be stamped, each character on the band being formed by an assemblage of perforations made automatically, the band fulfilling the function of stencil-plate. While this apparatus allows printing which is of almost even quality, it is, however, of limited use in stamping by paint, or inking, and hardly permits printing of small-scale characters because of poor legibility.

Therefore, the purpose of the present invention is to provide a stamping apparatus which permits automatic stamping by inking and/or deformation of the surface of the articles to be stamped, and which makes it possible to obtain perfectly legible printing, whatever the number and size of the characters to be stamped and whatever the degree of flatness of the surface to be stamped.

This purpose is achieved by an apparatus of the aforementioned type, in which the stamping unit includes: several independent stamping modules, each having a character-support and self-driving and stopping means for this character-support; a preselecting assembly having an input unit and connected to said stopping means to stop in the stamping position a character from each of said modules as per instructions supplied to said input unit; and actuating means capable of actuating individually each of the character-supports of said stamping modules to bring into the working position the character of each of these supports placed in the stamping position and print individually each of said predetermined characters.

The individual actuating of each character-support allows legible printing of the characters, since the printing of a character is effected independently of the others. Moreover, the modular embodiment of the stamping unit allows one or several modules to be placed rapidly in or out of service depending on the number of characters to be printed.

According to an initial characteristic of the device in conformity with the invention, each stamping module is mobile in a movement of translation between an initial position, i.e., position of rest, and a second position, i.e., working position, and said actuating means have displacement control means for bringing the stamping modules from the position of rest to their working position, said stamping modules being capable of travelling different lengths, so that in the working position, the assemblage of characters in the stamping position basically corresponds to the profile of the surface to be stamped. An initial means of embodiment consists in associating individual displacement control means with each stamping module, which is then mobile in a movement of translation independently of the others. A second means of embodiment consists in mounting the stamping modules in a translationally mobile frame, the mounting of each module being achieved by flexibly deformable elements. Each character in the stamping position may thereby make actual contact with the surface to be stamped, e.g., under the effect of a force applied to the stamping module which supports it.

Another characteristic of the apparatus according to the invention is that the preselecting assembly includes: identification devices, each associated with a stamping module and capable of emitting an identification signal of the character of this module in the stamping position, comparator devices receiving on their input units said identification signals and preselection signals emitted by said input unit, each comparator device being associated with a stamping module and capable of emitting a signal to control the immobilization of the character-support of this module when the identification and preselection signals applied to these inputs of the comparator device coincide.

Each identification device associated with a stamping module advantageously includes an assemblage of markers equal in number to the number of characters on the character-support of this module, each marker occupying a fixed relative position in relation to a character with which it is associated, and a detector in a fixed position in the stamping module and before which pass in succession said markers when the character-support is driven on itself, said detector emitting the identification signal of a character when the markers corresponding to this character pass before it.

Still another characteristic of the apparatus according to the invention is that, for ink-stamping of the surface to be stamped, at least one inking device is provided and which moves along a guide-path in order to ink the characters in stamping position borne by the character-supports when the latter are in the position of rest and for which they are spaced from the surface of the article to be stamped.

For stamping by deformation of the stamping surface, at least one stamping device is provided which can exert, individually, on each character in the stamping and working position, a stamping force. In this case, each stamping module advantageously includes a striking surface, or anvil, for receiving said striking or stamping force, while the actuating means include means for driving a striking or stamping element in front of several anvils, control means for stopping this stamping element in front of each anvil, and control means for operating said stamping element.

Other characteristics and advantages of the apparatus according to the invention will become evident upon reading the description of one particular method of embodiment, given below as a non-limiting example, with reference to the attached drawings, wherein:

FIG. 3 is a partial view of a stamped metal sheet;

FIG. 6 is a partial side view of the module shown in FIG. 5;

FIG. 7 is a partial view of the inner surface of the character-support strip shown in FIG. 5;

FIG. 8 is a view of a method of embodying the preselecting device of the unit for ink-stamping the apparatus shown in FIG. 4;

FIGS. 1 and 2 illustrate a special method of setting up an apparatus according to the invention for stamping metal sheets obtained upon exiting from a rolling facility.

Figure 1:
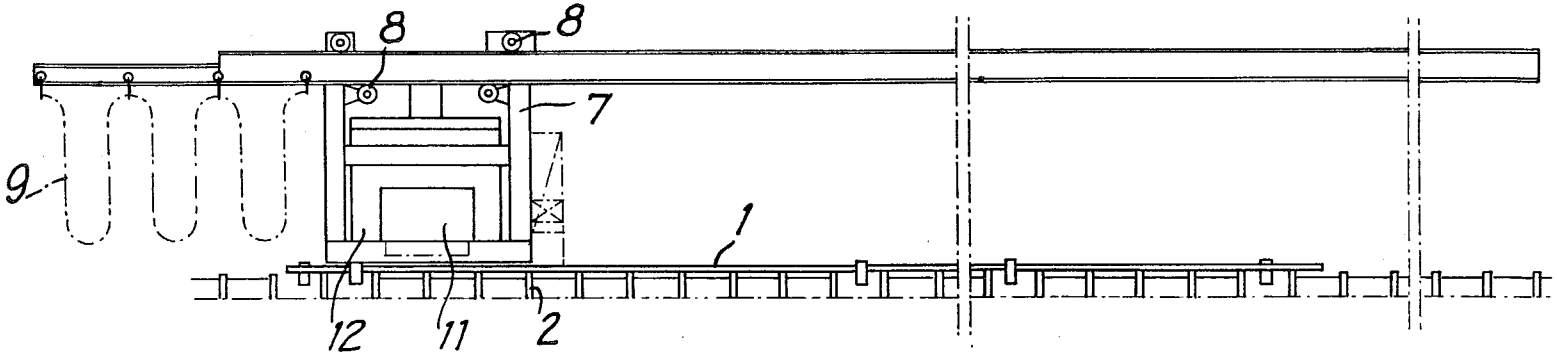
FIG. 1 is a front view of a particular means of installing an apparatus according to the invention.
Figure 2:
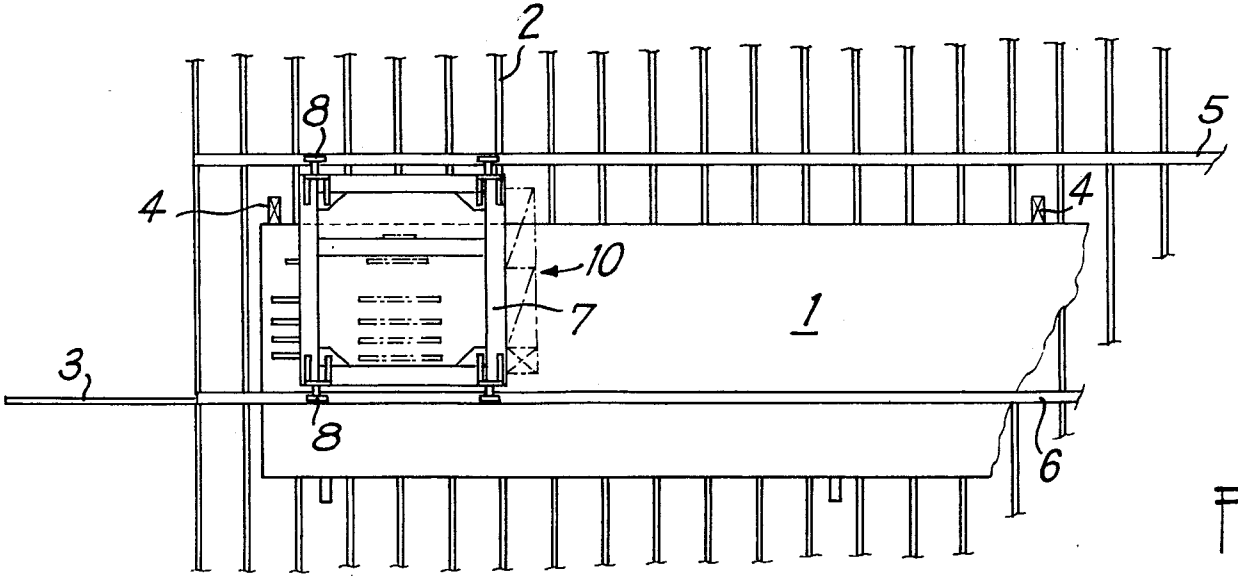
FIG. 2 is a top view of the assembly illustrated in FIG. 1.

A metal sheet 1, called mother sheet, leaves the roller and passes into a leveler; then it is turned around for inspection on both its surfaces and is arranged on rails 2, 3. Sheet 1 is placed laterally against side props 4 so that it is arranged below two guide-rails 5, 6 parallel to the longitudinal direction of sheet 1.

A frame 7 provided with wheels 8 is suspended from guide-rails 6 and moves along these rails by means of a motor (not shown), e.g., a pneumatic motor supplied by compressed air from a flexible pipe 9.

Frame 7 includes a marking device 10 according to the invention and which, in the example given, has an ink-stamping unit 11 and a unit for stamping by deformation 12.

With the mother sheet 1 in place against side props 4, frame 7 is led to the extremity of sheet 1, then moved above sheet 1 for the successive stampings of the various daughter sheets obtained by cutting out the mother sheet. The positioning of frame 7 for the stamping of each daughter sheet can be carried out either manually or automatically. For automatic control of displacement of frame 7, a sensor may, for example, be used, particularly a photoelectric one on the extremity of the mother sheet 1, in order first of all to immobilize frame 7 over the end part of the mother sheet, and to stamp the first daughter sheet, and then in order for frame 7 to accomplish successive displacements of predetermined lengths equal to those of the daughter sheets to be stamped successively. On each daughter sheet, characters 13 are printed by inking and characters 14 are printed by deformation (FIG. 3).

Characters 13 printed by inking provide various information, particularly on the manufacturer, place of manufacture, quality of the metal, casting number, dimensions of the daughter sheet and its location in the mother sheet, as well as the intended recipient of the daughter sheet. The height of characters 13 ranges from 50 to 100 mm so that they may be read during handling of the daughter sheets by means, for example of a rolling bridge.

The height of characters 14, printed by deformation, is smaller than that of characters 13, e.g., approximately 10 mm. These characters 14 provide certain information analogous to that provided by characters 13, and since they are permanent, constitute the reference stamping. Ink-stamping units 11, and deformation-stamping units 12 are described below in more detail.

Unit 11 (FIGS. 4 to 7) includes a plurality of stamping modules 100 which slide-mounted vertically in a carriage 15 of one piece with frame 7, modules 100 each being vertically guided in an individual housing 16 of carriage 15.

Each module 100 participates in the stamping of a character 13. Thus, modules 100 are arranged in parallel rows in numbers at least equal to those of the lines of characters 13 to be printed, each row having a number of modules at least equal to that of the characters to be printed in the corresponding line.

Each module 100 has a frame element 101 housed in a housing 16 and of one piece, in its upper part 101*a* with the mobile rod 102 of a double-acting jack 103 connected by a supply circuit to a source of compressed air and whose fixed cylinder 104 is of one piece with frame 7.

A character-support 105 is mounted in frame element 101 and is embodied in the form of a flexible band bearing characters 106 constituted, by example, by rubber parts affixed onto the outer surface of band 105, preferably at regular intervals. The inner surface of band 105 is notched by a series of ribbings 105′ and grooves 105″; said band passes over a driving pinion 107 and two recall pinions 108, 109 mounted on the shafts carried by frame element 101 (FIG. 6). Band 105 rotates movably on itself under the effect of a motor 110 mechanically coupled to wheel 107 and mounted on frame element 101. A brake 114 acting on a wheel 115 of one piece with the shaft of motor 110 immobilizes band 105 when this motor is shut off.

Recall pinions 108, 109 are mounted on the lower part of frame element 101, on two parallel horizontal shafts 111, 112, the spacing between them being almost equal to the width of a character 106 affixed onto band 105. Thus, the character in the stamping position such as 106′ (FIG. 6) borne by the section of band 105 situated in the interval betweeen pinions 108 and 109, occupies a horizontal position, parallel to the surface to be stamped, since said band section is then rectilinear. Each character in the stamping position extends below the lower level of frame element 101.

A preselecting device, which will be described in detail below, controls the passage to the stamping position and the stopping in this position of an assemblage of characters 106, each borne by a different stamping module, as a function of the instructions furnished to the input of this preselecting device. During this preselection process, modules 100 are maintained in the position of rest, spaced from the surface to be stamped, by means of jacks 103.

Figure 4:
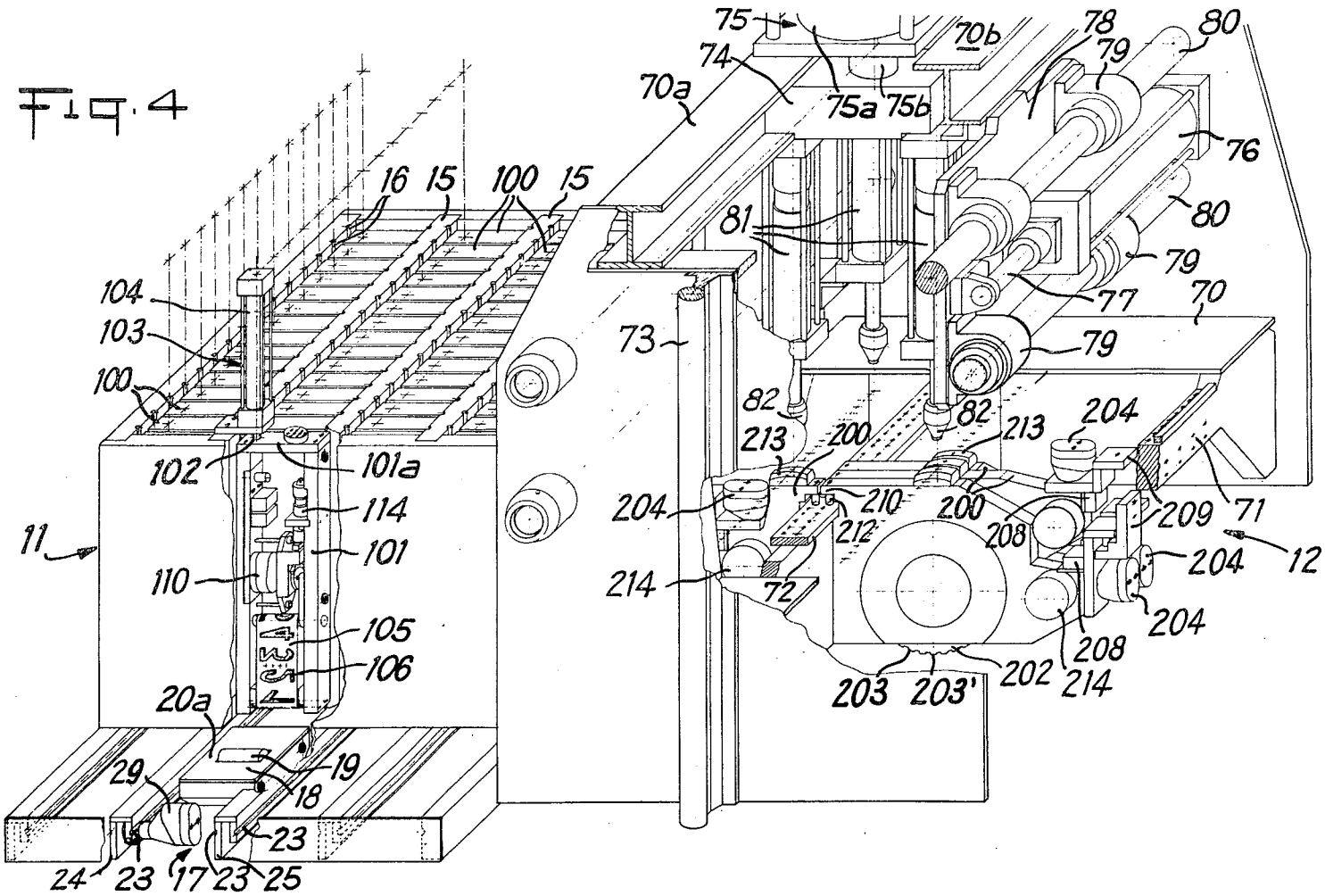
FIG. 4 is an overall perspective view of an apparatus according to the invention.
Figure 5:
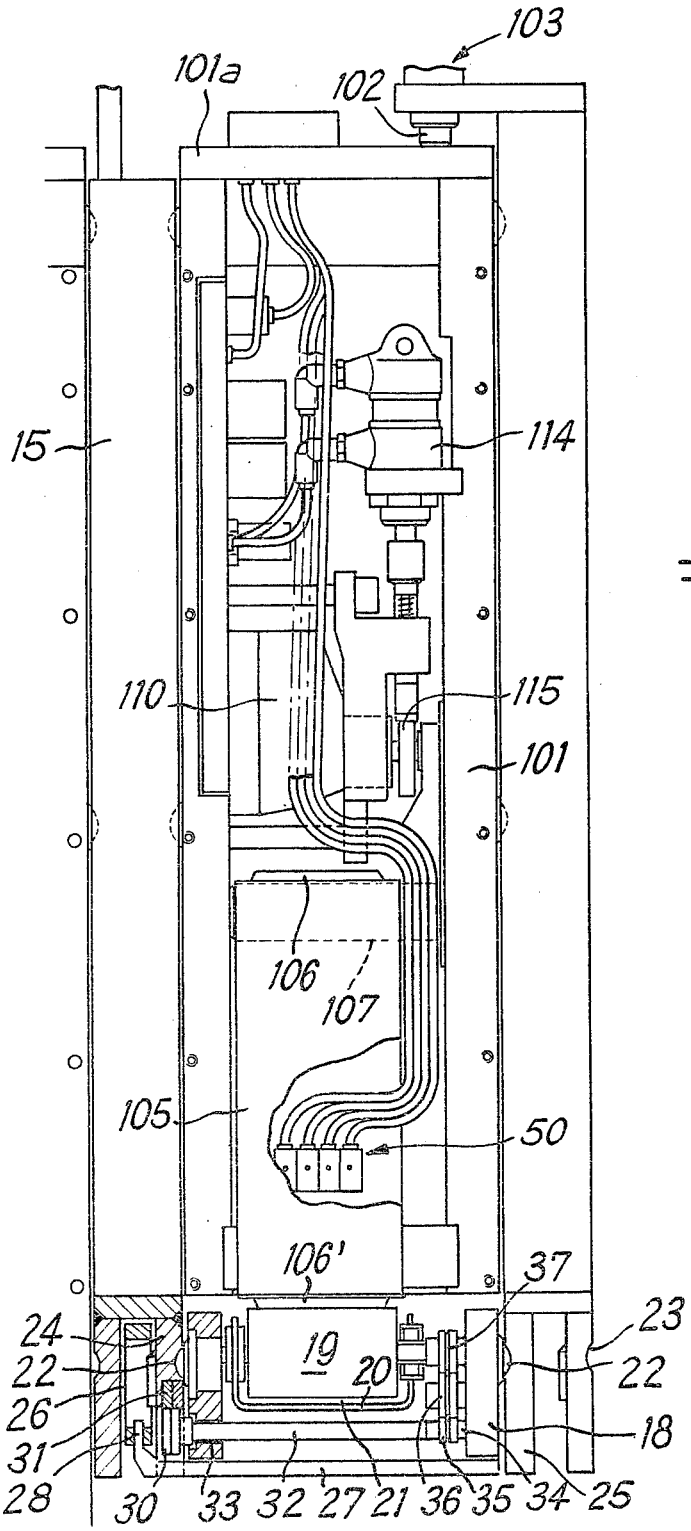
FIG. 5 is a front view of a stamping module and of the inking device of the unit for stamping by inking the apparatus shown in FIG. 4.

When the assemblage of predetermined characters have been placed in the stamping position, with modules 100 occupying their position of rest (as illustrated in FIGS. 4 and 5), the inking of these characters is effected by means of an inking device 17. In the example illustrated, the characters in the stamping position are, for the rest position of modules 100, situated in the same horizontal plane. Thus, the inking device 17 includes a carriage 18 which has an ink roller 19 which is translationally mobile horizontally under modules 100 so that when carriage 18 moves, ink roller 19 passes over all of the characters in the stamping position of the modules from the same row. In FIG. 4, only one carriage has been shown, but it is obvious that analogous carriages are provided, equal in number to the number of rows of modules 100.

Carriage 18 has, in an air-tight housing 20, an ink supply 21 in which the lower part of roller 19 is soaked. Carriage 18 is closed by a cover 20*a* (FIG. 4) with an opening for the upper part of ink roller 19. Carriage 18 is provided on its side with bearings, or wheels 22, which fit into guide-paths 23 constituted by horizontal grooves made in rails 24, 25 integral with frame 7.

Along one of these rails, 24, an endless chain 26 is arranged and which passes over a drive wheel and a return wheel (not shown), these wheels being mounted on the extremities of rail 24. A rod 27 is attached under carriage 18 and has at its extremity a ratchet engaged in a link of chain 26. Chain 26 is driven by a motor 29 attached to one end of rail 24.

On the side of carriage 18 adjacent to rail 24 a pinion 30 is mounted which gears with a fixed horizontal rack 30 attached to rail 24. When motor 29 is actuated, causing the movement of chain 26, carriage 18 moves along rails 24 and 25, and, simultaneously, pinion 30 is driven in rotation. Pinion 30 is integral with a shaft 32 and is mounted on its extremity, this shaft crossing the wall of carriage 18 with interpositioning of a sealing joint 33 and supported on its other extremity by a bearing 34 attached to the inner wall of carriage 18. A second pinion 35 is mounted on shaft 32 and inside carriage 18, and is integral with this shaft, gearing with an intermediate pinion 36 which in turn gears with a pinion 37 integral with the mounting shaft of ink roller 19. This mechanical transmission causes, at the same time as the translation of carriage 18, the rotation of roller 19, which then moves against the characters in stamping position, in a direction which is opposite that of the displacement of carriage 18.

The inking of the characters in stamping position on modules 100 from the same row is accomplished during one outward trip, or one round trip, of the carriage along rails 24, 25, the carriage being immobilized at one end of its trajectory following the inking operation. It should be noted that rails 24 and 25 extend from the row of modules 100 to which they are associated, on both ends of this row, and that the spacing of these rails is greater than the width of these modules, so that neither rails 24, 25 nor carriage 18 in its immobilized position, nor the driving means of said carriage can interfere with the downward movement of modules 100 for printing.

Driving of the carriage by means of motor 29 may be done either manually or automatically, as described below.

When all of the characters in stamping position 106 have been inked and when frame 7 is stopped over the daughter sheet to be stamped, the printing is caused by the vertical downward sliding of modules 100 into their housings 16. The translational displacement of modules 100 is controlled by the pressurizing of the upper chambers of jacks 103. Each module 100 comes into the working position and applies the character in stamping position which it bears onto the surface of the metal sheet.

The displacement into the working position of modules 100 may be controlled manually, as may their return into the position of rest, by re-establishment of the compressed air supply in the lower chambers of jacks 103. This control may also be automatic, as described further on.

Modules 100 slide toward their working position independtly of one another, each under the control of an associated jack 103 (one of these jacks is illustrated in FIG. 4). These modules 100 can thus accomplish strokes of different lengths and thereby bring each character in stamping position into actual contact with the surface of the metal sheet, even though the latter may not be perfectly flat. Thus, despite the unevenness in the surface and whatever the number of characters to be stamped, a perfectly legible impression is obtained.

One particular method of embodying a preselecting device of ink-stamping unit 11 will be described below, with reference to FIGS. 7 and 8.

The preselecting device, schematically represented in FIG. 8, includes an input unit 40, character-identification devices 50*a* to 50n, and a pneumatic preselecting circuit 60.

Input unit 40 has a data support 42 reader 41 such as a tape or perforated card. Controlled by a signal S, reader 41 reads a series of instructions for stamping a specific daughter sheet; signal S may, for example, be emitted when frame 7 begins to move in the direction of this daughter sheet which is to be stamped.

The instructions read and which correspond to the characters to be ink-stamped are memorized by circuits 42*a*, 42*b* . . . 42*n*, each of these circuits memorizing in binary form the data corresponding to a character which is to be stamped by a specific stamping module. Associated with each circuit 42*a*, 42*b* . . . 42*n*, thus, is a specific stamping module bearing a character-support band, 105*a*, 105*b* . . . 105*n*, respectively. Since the preselection operations for modules 100 bearing bands 105 are identical and are carried out in parallel, only one will be described hereinafter, assigning a reference a to those elements which allow this single operation to take place.

The binary code corresponding to the character carried by band 105*a* which is to be selected is transcribed pneumatically by an electropneumatic converter 42*a* supplied by a pressurized fluid through a supply line 44*a* shunted onto line 9. In the case illustrated in FIG. 8, this is a four-bit code, but may of course be selected as a function of the number of characters, digits or letters, or both, carried on band 105*a*.

The data memorized in circuit 42*a* are transmitted pneumatically through lines 45*a*, 46*a*, 47*a*, 48*a* to the initial inputs of a comparator circuit 60*a* of preselecting circuit 60. This comparator circuit receives, on its second inputs the binary information transmitted by lines 55*a*, 56*a*, 57*a*, 58*a*, corresponding to the character of band 105*a* in stamping position and supplied by an identification device 50*a*.

Identification device 50*a* has a so-called leak-type detection circuit, including lines 51*a*, 52*a*, 53*a*, 54*a* shunted between a line 39 linked to line 9 and lines 55*a*, 56*a*, 57*a*, 58*a*, respectively. This detection circuit also includes an assemblage of markers 113*a*, equal in number to the characters 106*a* carried by band 105*a*, each marker 113*a* being associated with a character 106*a*.

In the example illustrated, markers 113*a* are each constituted by a group of projecting parts 113'*a* and recesses 113''*a* formed on the inner surface of band 105*a*, all extending transversally over this inner surface of band 105*a* and distributed with spacing equal to that of the characters on the other side of the band. Projecting parts 113'*a* are formed by sections of ribbing 105'*a*, while recesses 113''*a* are formed by notching these ribbings to the bottom of grooves 105''*a* (see FIG. 7). Markers 113*a* are constituted by different combinations of projections 113'*a* and recesses 113''*a*, each of these markers constituting a type of binary physical representation of the character to which it corresponds.

Fixed lines 51*a*, 52*a*, 53*a* and 54*a* emerge in the immediate proximity of the surface of ribbings 105'*a* and are arranged so that marker 113*a* situated in front of, i.e., at the mouth of these lines corresponds to character 106*a* in stamping position. While band 105*a* is driven by motor 110*a*, actuated, for example, pneumatically, the pressure prevailing in one of lines 51*a* to 54*a* assumes an initial value when it emerges in proximity to a projection 113'*a*, and a second value, lower than the first, when it emerges in front of a recess 113''*a*, the compressed air then escaping through a grove 105''*a*. Lines 55*a* to 58*a* thus transmit to the comparator circuit 60*a* the binary data corresponding to character in stamping position 106*a*. Note that, in the spaces between two successive markers, lines 51*a* to 54*a* all emerge in front of the recesses and that this code will thereby not be assigned by a character 106*a*.

Comparator circuit 60*a* emits, on lines 61*a*, an output control signal when the signals received on its first and second inputs coincide. This comparator circuit may be embodied by known means using an assembly of pneumatic elements embodying the AND function.

The control signal emitted by circuit 60*a* interrupts the pressurized fluid supply of motor 110*a* by acting on a distributor 62*a* branched onto a supply line 110'*a* linking motor 110*a* to line 39. This control signal simultaneously actuates a pneumatic brake 114*a* by acting on a distributor 63*a* branched onto a line 114'*a* linking this brake to line 30.

The preselection of other stamping modules for immobilizing bands 105*b* to 105*n* is effected analogously by means of electropneumatic converters 43*b* to 43*n*, identification devices 50*b* to 50*n*, and comparator circuits 60*b* to 60*n*.

When, following the emission of a new signal S, the new instructions read correspond to different characters, the outputs of comparators 60*a* to 60*n* change states, interrupting the action of the pneumatic brakes and causing bands 105*a* to 105*n* to be driven for a new preselection process.

The method of embodying a preselecting device as described above and which includes pneumatic logic elements, is particularly suited for stamping metal sheets exiting from a rolling apparatus whose temperature is thereby quite high (200 to 300° C.). Yet, if prevailing conditions allow, this preselecting device may be embodied by means of electric logic elements, it being possible for the motors and brakes to be actuated electrically or electromagnetically, and for the character-identification devices to be constituted by magnetic detectors associated with markers embodied in the form of ferromagnetic metal parts affixed onto the inner surface of the character-support bands.

It may be seen that when one or several of the characters to be stamped are invariable, as for example the characters relating to the manufacturer and to the place of manufacture, stamping modules can be used which include only one character in the fixed stamping position, associated with a jack such as 103 and lacking a drive motor, brake and character-identification device, since no preselection is then required.

In addition, on one or several bands 105 a blank space may be provided in addition to characters 106, said blank space being assigned a code in order to allow printing of a varying number of characters with no need for modules 100 to be placed in or out of service. Each character or blank space represents a "character position."

It will also be noted that several housings 16 of frame 15 may remain free so as to provide, on the surface to be marked, spaces between the groups of characters on the same line.

It will be noted lastly that the modular structures of the stamping unit and of its preselecting device allow them to be mounted easily and modified for adaptation to different stamping capabilities.

The stamping process by deformation will now be described, with reference to FIGS. 4 and 9.

The unit includes a plurality of stamping modules 200 each of which participates in the stamping of a character 14.

Each module 200 has a housing 201 in which a character-wheel 202 is mounted, rotating around a horizontal axis supported by housing 201. Several rows of modules can be provided, equal in number at least to the lines of characters 14 to be printed, each row having a number of modules equal at least to that of characters 14 to be printed in the corresponding line. In each row, wheels 202 are mounted around aligned horizontal axes.

Wheels 202 bear characters 203 on their periphery, said characters embodied, for example, in the form of steel members, and preferably distributed evenly on the circumference of each wheel 202.

Figure 9:
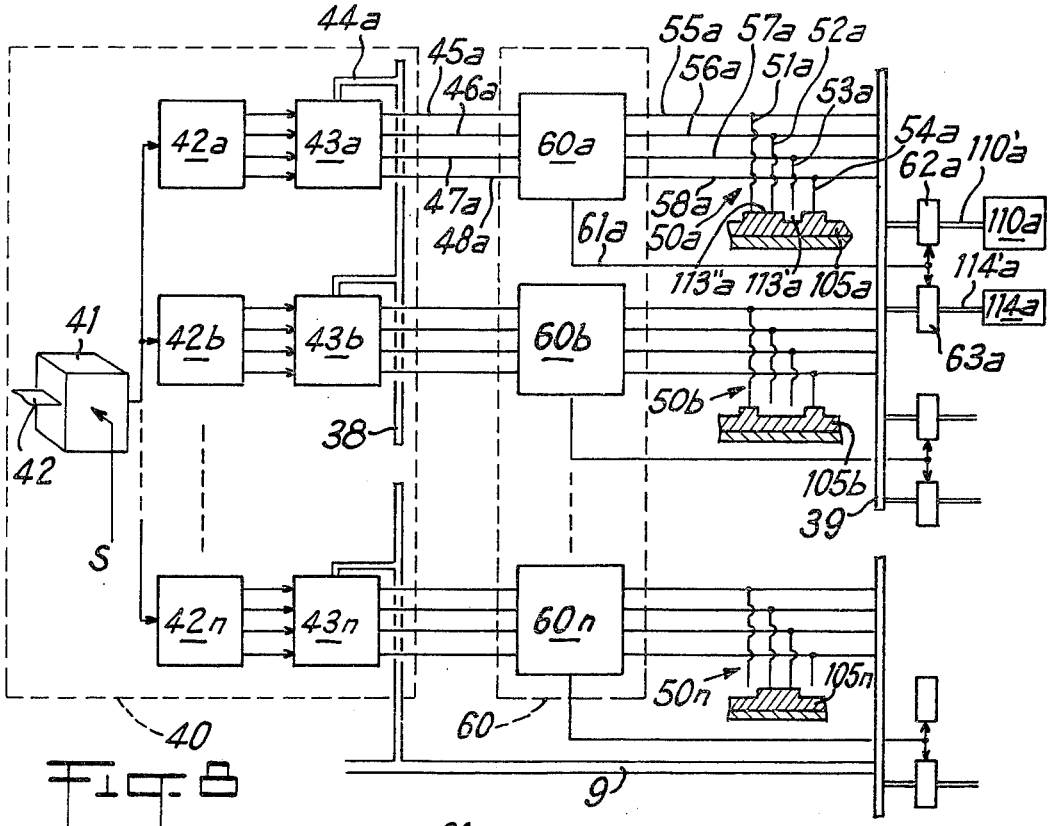
FIG. 9 is a partial front and sectional view of the unit for stamping by deformation of the apparatus shown in FIG. 4.

Each module 202 has a motor 204 which may be pneumatic and which is coupled mechanically to a tooth-wheel 205 linked by a chain 206 to a second tooth-wheel 207 integral with character-wheel 202 and coaxial with it (FIG. 9). Each module also has a brake 208, which may be pneumatic and which is associated with wheel 205.

Because of the space occupied by motors 204 and in order to avoid too large a space between two adjacent character-wheels, motors 204 are mounted on successive housings 201, alternately on one vertical side and on the upper side of these housings (see especially FIG. 4).

The dimensions of modules 200 of different rows may vary depending on whether the character-wheels of these modules carry letters, numbers and letters, or only numbers.

Housings 201 have mounting brackets 209, 210 which are connected to a framework 70. The brackets 209 of housings 201 of modules 200 belonging to the same row are attached to a bar 71 of framework 70, extending parallel to this module row, flexible mounting elements 211 being interposed such as, for example, rubber or polyurethane blocks. Brackets 210 are similarly attached to a bar 72 by means of flexible elements 212.

Framework 70 is slide-mounted into frame 7, on vertical slide-rods 73. The vertical displacement of framework 70 is assured by a moving means including a jack 75 whose cylinder **75*a* is of one piece with frame 7 and whose piston rod 75*b* is attached to a brace 74 welded onto beams 70*a*, 70*b* of framework 70**.

The lowering of framework 70 and thus the bringing into working position of the characters in stamping position carried by modules 200 is controlled, for example, by interrupting the compressed air supply of jack 75 and by causing the lower chamber of this jack to communicate with the atmosphere by means of a distributor and regulator of flow (not shown) which make it possible to adjust the speed of descent of framework 70.

Two shafts 80 are affixed to framework 70 and extend parallel and over each row of modules 200. A carriage can slide on these shafts 80 and includes a vertical plate 78 and bearings 79. This carriage moves translationally along shafts 80 by a transferring means including a double-acting jack 76 whose cylinder is integral with framework 70 and whose horizontal mobile rod 77 is integral on its extremity with plate 78.

On plate 78, on the side opposite bearings 79, one or several striking jacks 81 are attached and which have on the end of their rods, a hammer 82 and which move in translation under the action of jack 76. Associated with each row of modules 200 is at least one striking jack 81 which moves over and along a row of striking surfaces or anvils 213, each affixed to the upper part of a housing 201.

In FIG. 4, only one assembly for supporting, driving and guiding by means of at least one striking jack has been shown, associated with a row of modules 200, but it goes without saying that an assembly such as this is associated with each row of modules 200.

The operation of stamping by deformation unit 12 is as follows:

Under the control of signal S, the preselection of the characters to be placed in stamping position is achieved. To do so, reader 41 provides the data relating to characters 14 to be stamped by deformation and a device is used which is similar to that described by the ink-stamping unit and which includes electropneumatic converter circuits, comparator circuits and character-position detector devices; the comparator circuits emit the control signals for stopping 204 and actuating brakes 208.

Since character-supports 202 are wheels, markers will be used which are combinations of solid parts and of orifices arranged, for example, radially on each wheel 202, or on one wheel 214 rotationally integral with the latter and distributed angularly in an even manner. The detectors associated with the wheels bearing the markers are leak-detectors analogous to those described above, each detector having conduits whose outlet orifices are aligned along a spoke of the associated wheel bearing the markers.

When the preselection process is completed and when all the characters selected are in their stamping position 203', extending beyond the lower part of housing 201, the compressed air supply of jack 75 is shut off, this having maintained framework 70 and modules 200 in the position of rest, spaced from the surface to be stamped. Framework 70 and the modules 200 which it carries then slide downwards vertically under the effect of gravity, each module 200 assuming the working position in order to bring the character in stamping position which it carries towards the surface to be stamped.

When modules 200 are in working position, the characters in stamping position are printed by means of striking jacks 81 which, by their hammer 82, exert a percussive effect on an anvil 213. The characters are printed one after another by successive displacements of jack(s) 81 along the rows of modules 200 with which they are associated i.e. the jack(s) 81 move from a position of registry with one anvil to a position of registry with the next adjacent anvil, and so on.

If, after modules 200 have assumed the working position, a character 203' in stamping position is not in perfect contact with the surface of the metal sheet, for example because of the presence of a depression in this surface, hammer 82 of jack 81, in contact with anvil 213 of module 200 carrying this character 203', will continue its downward stroke until this character 203' effectively succeeds in deforming the surface to be stamped.

This independence of the strokes of modules 200 is made possible by flexible mounting elements 211 and 212 which may be more or less compressed.

One or several jacks 81 may be used per row of module; the number of simultaneously-actuated jacks should, however, be limited so as not to exert too great a striking force on the metal sheet to be stamped and which rests merely on rails. Since anvils 213 are struck individually, the perfectly legible printing of characters 14 is obtained.

Preferably, each anvil 213 carried by a module 200 is connected mechanically to the axis around which the character-wheel 202 of this module turns so that the percussive effect is transmitted to this axis.

As indicated for the ink-stamping unit, modules for stamping by deformation may be used which have only one character in stamping position for printing information which remains the same, and spaces may be made between neighboring deformation-stamping modules, on the same row, said spaces corresponding to the intervals between groups of characters 14 from the same line.

The stamping cycle of apparatus 10 may occur as follows:

- displacement of apparatus 10 to the vertical of a daughter sheet to be stamped, as controlled by signal S;
- preselection of characters from stamping units 11 and 12 during this displacement and, possibly, after apparatus 10 has stopped;
- inking of the characters in stamping position of unit 11 and lowering of the assembly of modules 200 until contact is made with the sheet, controlled by a signal T after the preselection process has ended;
- ink-stamping, from control signal U;
- stamping by deformation, from signal V for controlling the successive displacement and actuating of striking jacks 81;
- raising of modules 11 and 12 after stamping, under the control of a signal W.

The emission of signal S after the modules have been raised may be controlled by an operator, and the displacement of apparatus 10 from one sheet to the next may be carried out by manual control. The duration of a stamping cycle for stamping a daughter sheet with characters 13, 14, as illustrated in FIG. 3, is approximately 1 minute.

Figure 10:
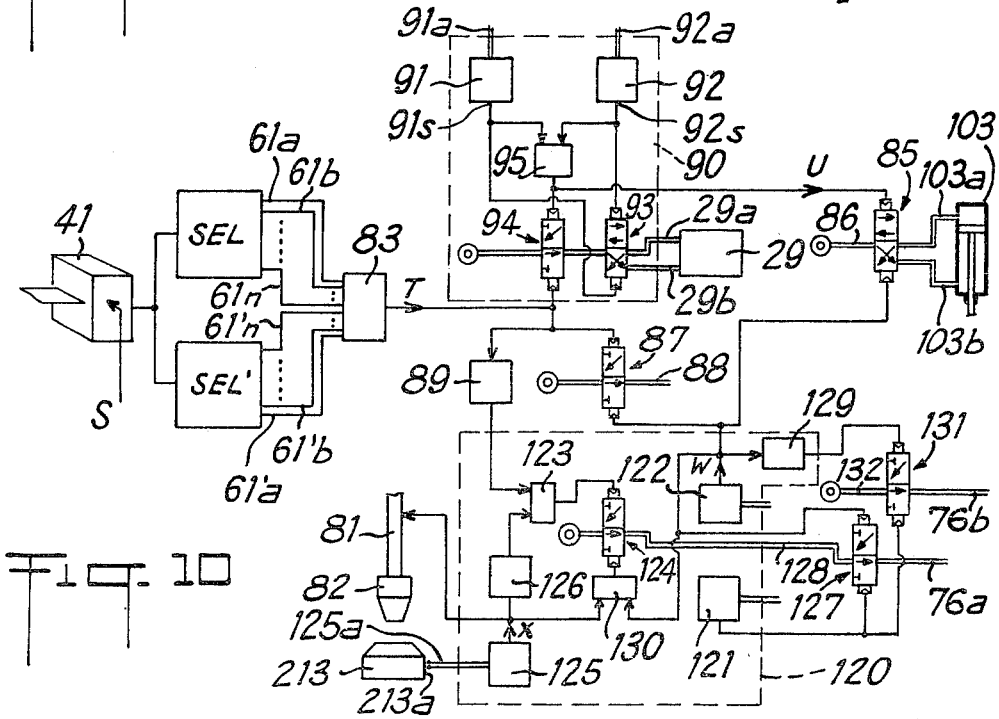
FIG. 10 is a view of a method of embodying a control circuit of the apparatus shown in FIG. 4.
Figure 9:
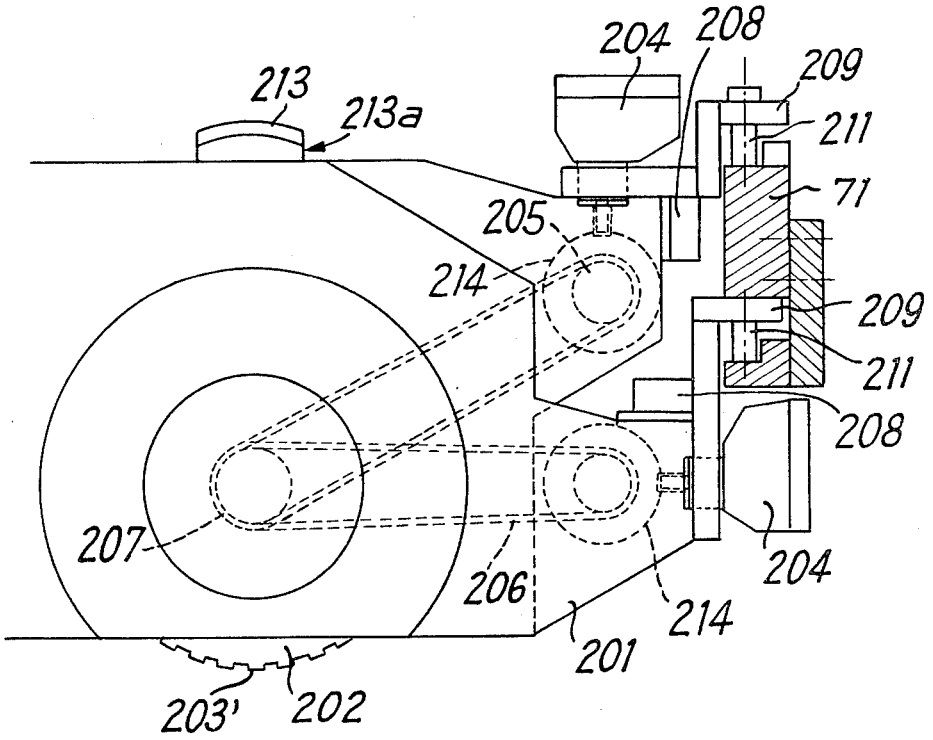

One particular means of embodying a circuit for controlling a stamping cycle will now be described, with reference to FIG. 10.

In response to the appearance of signal S, preselecting device SEL of stamping unit 11, and SEL' of stamping unit 12 preselect the characters to be placed in stamping position. Following the preselection, each comparator circuit 60*a*, 60*b* . . . 60*n* of the SEL device shows an output state which may be identical to logic level 1. Conduits 61*a*, 61*b* . . . 61*b* connected to the outputs of these comparator circuits, as well as conduits 61'*a*, 61'*b* . . . 61'*n*, connected to the outputs of the comparator circuits of preselecting device SEL, are connected to the inputs of a coincidence circuit 83, embodying the AND function and which emits an output signal T in the form of a pulse when it detects the same logic level 1 on all of its inputs.

Signal T is applied to the input of a control circuit 90 of inking device 17. Conrol circuit 90 has end-of-stroke detector devices 91, 92 which emit an end-of-stroke signal to their outputs 91*s*, 92*s* when carriage 18 reaches the extremities of its trajectory. The end-of-stroke detector circuits may, for example, be leak-detectors placed on the extremities of the stroke of carriage 18, each of these detectors having a compressed-air supply line 91*a*, 92*a*, and which emerges at the inner lateral surface of one of the guide-rails 24, 25 at its end part. When the carriage reaches the end of its stroke, at one of the extremities of rails 24, 25, it seals off one of the lines 91*a*, 92*a*, which causes an end-of-stroke signal to be emitted by the corresponding detector.

The pneumatic drive motor 29 of carriages 18 can turn in either direction, depending on whether it is supplied by a conduit 29*a* or a conduit 29*b*. Selection of the supply line of motor 29 is carried out by means of a commutating device 93 controlled by the end-of-stroke signals so that, when carriage 18 is stopped at one end of its trajectory, motor 29 is driven in the direction required to bring carriage 18 to the other end of its trajectory.

Commutating device 93 is supplied by a line 84 on which a switching device 94 is mounted. When the carriage is stopped at one end of its path, switch 94 is open. Pulse T causes the closing of this switch and motor 29 to be supplied with compressed air. When the carriage reaches the other end of its path, the corresponding end-of-stroke detector emits an end-of-stroke signal to an OR circuit 95 which in turn emits a pulse signal U for controlling the opening of switch 94, causing the carriage to stop.

Signal U is also applied to an inverter device 85, mounted between a compressed air supply line 86 and supply lines 103*a*, 103*b* in parallel, for the upper and lower chambers of jacks 103. When control signal U is emitted, all of modules 100 assume the working position.

At the same time as signal T is controlling the inking of the characters of stamping unit 11, it is applied to a switching device 87 mounted on a compressed-air supply line 88 of jack 75. Signal T causes switch 87 to open so as to control the lowering into working position of modules 200.

Signal V is derived from signal T by delaying the latter using a time-lag device 89 which lasts at least as long as the amount of time required for modules 200 to descend. This signal V is applied to the input of a circuit 120 for controlling the displacement and the actuating of striking jack(s) 81.

Circuit 120 has two end-of-stroke leak-detectors 121, 122 of jack 76, similar in construction to that of detectors 91, 92 and which, associated with plate 78 emit end-of-stroke signals when the striking jack(s) on this plate reach the limits of their trajectory.

Thus, before the start of the printing by deformation operation, the striking jacks are at a first extremity of their trajectory and end-of-stroke detector 121 emits an end-of-stroke signal which, applied to a switching device 127, establishes the connection between a conduit 76*a* linked to jack 76 and a supply line 128.

Signal V is applied by an OR circuit 123 to a switching device 124 mounted on line 128 and controlling its closure. Each striking jack is then displaced by jack 76 in the direction of the second extremity of its trajectory.

An anvil detection device 125 emits a signal X when jack 81 reaches the vertical of the anvil which it is supposed to strike. Detection device 125 may be, for example, a leak-detector having a line 125*a* which is translationally integral with jack 81 and which emerges on a level with the aligned vertical sides 213*a* of anvils 213 which are to be struck by jack 81. When the aperture of line 125*a* passes in front of surface 213*a*, detector 125 gives off signal X which causes switch 124 to close and thus jack 81 to stop. This signal X, which may be slightly delayed, controls the actuations of jack 81, whose hammer 82 then strikes anvil 213, first hanging over it and then re-ascending.

Signal X, delayed by a time-lag device 126 whose delay lasts at least as long as the time required for jack 81 to strike and re-ascend, once more controls the closing of switch 124 by means of OR circuit 123, and jack 76 is power-supplied once again to move.

It will be noted that it is possible either to associate an anvil detection device with each striking jack in order to control the immobilization of jack 76 and its activation each time, or to associate an anvil detection device with a single striking jack, insofar as anvile 123 are all arranged at regular intervals, and to activate all jacks simultaneously.

It will be noted that the vertical sides 213*a* of the anvils are high enough to compensate for possible differences in the level of modules 200, since the anvil detector moves horizontally.

When all of the anvils have been struck, the striking jacks thrust against their second end of stroke, jack 76 being supplied with compressed air. End-of-stroke detector 122 then emits an end-of-stroke pulse signal W, which also indicates the end of the stamping operation.

Signal W is applied to switches 85 and 87, causing them to close, and modules 100 and 200 to re-ascend into the position of rest, and to switch 127, whose opening it controls. This signal is also applied, by means of an OR gate 130, to switch 124, causing its opening. OR gate 130 also receives signal X.

Signal W, delayed by a time-lag device 129 of a duration equal at least to that of the re-ascent of the modules, is applied to a switching device 131 whose closing it controls. This switch, in the "on" position, establishes the connection between a supply line 132 and a line 76*b* linked to jack 76 in order to control the return of the striking jacks to the first end of stroke position. When the striking jacks have returned to the point of departure, end-of-stroke detector 121 emits an end-of-stroke signal which controls the opening of switch 131 and the closure of switch 127.

Another signal S may be emitted by the operator so as to proceed to the stamping of the next daughter sheet.

Various modifications or additions may be used in the method of embodiment described above for a stamping apparatus according to the invention without thereby leaving the protective framework thereof as defined by the attached claims.

Thus, it is obvious that marking solely by inking or solely by deformation can be accomplished.

In addition, the control of the individual arrival in the working position of the stamping modules may be effected by means of individual jacks in the case of stamping by deformation, especially if the surface to be stamped is appreciably uneven.

Likewise, the individual arrival in the working position of the stamping modules may be effected by using flexibly deformable elements for the mounting of these modules for the ink-stamping process.

The fact remains, however, that the requirement for careful application of the entire character to be printed on the surface to be stamped is greater for ink-stamping that for stamping by deformation and that the use, in the former case, of individual jacks is more capable of satisfying this requirement.

It should be noted, finally, that while the use of a stamping process according to the invention is suited to the stamping of metal sheets, in particular as concerns the stamping by deformation of heavy sheets, e.g., from 4 to 80 mm thick, this apparatus is not limited to this application and may also be suitable for stamping by inking and/or deformation of other, not necessarily metal articles the surfaces of which may be uneven.

I claim:

1. Apparatus for stamping an article, such as a metal sheet, by printing characters on a surface of said article, said apparatus including:

at least one stamping unit comprising a frame provided with guide means and a plurality of independent stamping modules mounted within said frame, each stamping module being guided by respective ones of said guide means for translational movement with respect to said frame, and each stamping module comprising a movable character support with a plurality of character positions at least one of which includes a character thereon, drive means for driving said support with respect to its associated module and stop means for stopping and immobilizing said support;

preselecting means, having an input unit and being connected to said stop means of each stamping module for bringing a character position of each character support into a stamping position facing said surface to be printed; and means for individually actuating each character support by translationally moving each stamping module independently of any other stamping module from a rest position, wherein a character of this module placed in stamping position is spaced from said surface to be printed, to a work position, wherein said character placed in stamping position is brought into contact with said surface to be printed, whereby the strokes of said stamping modules between the rest position and the work position are variable independently from each other, and in accordance with the relief contour of the surface to be printed.

2. Apparatus as claimed in claim 1, wherein said frame comprises at least one row of housings extending in parallel relationship to each other, each stamping module being slidably mounted in a respective housing.

3. Apparatus as claimed in claim 1, wherein each module is associated with a respective actuating means.

4. Apparatus as claimed in claim 3, wherein said actuating means includes at least one jack connected to a pressurized fluid supply circuit.

5. Apparatus as claimed in claim 1, wherein each module is mounted in said frame by elements which are flexibly deformable at least in the direction of translational displacement of said module relatively to said frame.

6. Apparatus as claimed in claim 1, wherein each input unit provides a preselection signal and wherein said preselecting means has identification means each associated with a stamping module for emitting an identification signal identifying the character position of this module in stamping position, a plurality of comparator means respectively connected to said identification means for receiving said identification signals and preselection signals emitted by said input unit, each comparator means being associated with a stamping module for emitting a signal for controlling immobilization of the character support of this module when the identification signal and the preselection signal applied to this comparator means coincide.

7. Apparatus as claimed in claim 6, wherein each identification means associated with a stamping module has an assemblage of markers equal in number to the number of character positions on the character support of this module, each marker occupying a relative fixed position in relation to a character position with which it is associated, and a detector having a fixed position with respect to the stamping module, and in front of which said markers pass in succession when the character support is driven, said detector emitting an identification signal identifying a character position when the marker corresponding to this character position passes in front of it.

8. Apparatus as claimed in claim 7, wherein said detector has several pressurized gas-supply lines emerging near the surface of a support bearing said markers and integral in movement with the character support, each supply line having a mouth, wherein said markers are constituted by different combinations of solid and grooved parts formed on said surface of the marker support, the pressure prevailing in each of the supply lines having an initial value when a solid part passes before its mouth, and a second value when a grooved part passes before its mouth, and each identification signal being binary and corresponding to a combination of pressure values prevailing in said lines, and wherein said preselecting assembly has an input unit for converting said instructions into pneumatic quantities, and a preselection circuit connected to said input units, to said identification means and to said immobilization means.

9. Apparatus as claimed in claim 1, wherein said drive means are pneumatically-actuated motors, and said immobilization means are pneumatically-actuated brakes.

10. Apparatus as claimed in claim 1, and comprising at least a first stamping unit for ink stamping said surface and a second stamping unit for stamping said surface by deformation thereof, said first and second units being associated with respective actuating means, said first stamping unit comprising an inking device which is movable along a path adjacent the characters in stamping position of the modules of said first unit in rest position, and said second stamping unit comprising a striking device for exerting a percussive force individually on each module of said second unit in work position.

11. Apparatus as claimed in claim 1, wherein said apparatus is movable along a guide path for displacement in parallel relationship to said surface to be stamped.

12. Apparatus for ink-stamping an article, such as metal sheet, by printing characters on a surface of said article, said apparatus comprising:

at least one stamping unit comprising a frame provided with guide means and a plurality of independent stamping modules mounted within said frame, each stamping module being guided by respective ones of said guide means for translational movement with respect to said frame, and each stamping module comprising a movable character support with a plurality of character positions at least one of which includes a character thereon, drive means for driving said support with respect to its associated module and stop means for stopping and immobilizing said support;

a preselection assembly having an input unit and connected to said stop means of each stamping module so as to bring a character position of each character-support into a stamping position facing said surface to be printed;

means for individually actuating each character-support by translationally moving each stamping module independently of any other stamping module from a rest position, wherein a character of this module placed in stamping position is spaced from said surface to be printed, to a work position, wherein said character placed in stamping position is brought into contact with said surface to be printed, whereby the strokes of said stamping modules between the rest position and the work position are variable independently from each other, and in accordance with the relief contour of the surface to be printed; and an inking device which is movable along a path adjacent the characters in stamping position of said modules in the rest position.

13. Apparatus as claimed in claim 12, wherein said frame comprises at least one row of housings extending in parallel relationship with respect to each other, each stamping module being slidably mounted in a respective housing and associated with a respective actuating means.

14. Apparatus as claimed in claim 13, wherein said actuating means includes at least one jack connected to a pressurized fluid supply circuit.

15. Apparatus as claimed in claim 12, wherein said inking device has a carriage which moves along a guide-path, an ink-roller on said carriage, an ink-supply mounted on said carriage, and wherein means are provided for driving the carriage along a trajectory passing opposite the characters in stamping position while the respective stamping modules are in said rest position, and means for stopping said carriage at at least one end of its trajectory.

16. Apparatus for stamping an article, such as a metal sheet, by printing characters on a surface of said article by deformation of said surface, said apparatus including:

at least one stamping unit comprising a frame provided with guide means and a plurality of independent stamping modules mounted within said frame, each stamping module being guided by respective ones of said guide means for translational movement with respect to said frame, and each stamping module comprising a movable character support with a plurality of character positions at least one of which includes a character thereon, drive means for driving said support with respect to its associated module and stop means for stopping and immobilizing said support;

a preselecting means, having an input unit and connected to said stop means of each stamping module, for bringing a character position of each character support into a stamping position facing said surface to be printed;

means for moving said stamping modules from a rest position, wherein the characters of said modules placed in stamping position are spaced from said surface to be printed, to a work position, wherein said characters placed in stamping position are brought into contact with said surface to be printed, ; and a striking device for exerting a percussive force individually on each module in the work position independently of any other module.

17. Apparatus as claimed in claim 16, wherein said frame comrises at least one row of housings extending in parallel relationship to each other, each stamping module being slidably mounted in a respective housing.

18. Apparatus as claimed in claim 16, wherein each module is mounted in said frame by elements which are flexibly deformable at least in the direction of translational displacement of said module relatively to said frame.

19. Apparatus as claimed in claim 16, wherein each stamping module has a striking surface which surface provides an anvil for receiving said percussive force, and including means coupled with said striking device for transferring said striking device from a position of registry with one anvil to a position of registry with another, adjacent anvil, said transferring means including means for effecting immobilization of said striking device to effect positioning thereof in said positions of registry and means for controlling the operation of said striking device whereby said striking device strikes each anvil individually.

20. Apparatus as claimed in claim 19, wherein said striking device is a striking jack which moves along a guide-path, and wherein said immobilization control means includes a device for detecting the presence of an anvil.

21. Apparatus as claimed in claim 19, and comprising several striking elements each capable of exerting successively a percussive force on the anvils of a respective assemblage of stamping modules.

* * * * *